United States Patent [19]

Silvestri, Jr.

[11] Patent Number: 4,576,008

[45] Date of Patent: Mar. 18, 1986

[54] TURBINE PROTECTION SYSTEM FOR BYPASS OPERATION

[75] Inventor: George J. Silvestri, Jr., Winter Park, Fla.

[73] Assignee: Westinghouse Electric Corp., Pittsburgh, Pa.

[21] Appl. No.: 569,866

[22] Filed: Jan. 11, 1984

[51] Int. Cl.[4] ..... F01K 13/02

[52] U.S. Cl. ..... 60/662; 60/663; 60/679

[58] Field of Search ..... 60/662, 663, 670, 679

[56] References Cited

U.S. PATENT DOCUMENTS

| | | | |
|---|---|---|---|
| 2,066,151 | 12/1936 | Johansson | 60/679 |
| 4,357,803 | 11/1982 | Dickenson | 60/679 |
| 4,403,476 | 9/1983 | Johnson et al. | 60/662 |

*Primary Examiner*—Allen M. Ostrager
*Attorney, Agent, or Firm*—D. Schron

[57] ABSTRACT

A steam turbine generator power plant which includes a main steam bypass path and an auxiliary steam bypass path which bypasses the high pressure turbine. The auxiliary bypass path includes a steam jet compressor which functions to pump up the pressure at the high pressure turbine exhaust to a value compatible with discharge into the main bypass path, and does so in response to measurement of the high pressure turbine output temperature.

6 Claims, 4 Drawing Figures

TURBINE PROTECTION SYSTEM FOR BYPASS OPERATION

BACKGROUND OF THE INVENTION

1. Field of the Invention

The invention in general relates to steam turbine bypass systems, and more particularly to a control arrangement for preventing excessive temperatures in the high pressure turbine when the bypass system is in operation.

2. Description of the Prior Art

In a typical steam turbine power plant, a steam generator such as a boiler produces steam which is provided to a high pressure turbine to a plurality of steam admission valves. Steam exiting the high pressure turbine is reheated in a conventional reheater prior to being supplied to a lower pressure turbine, the exhaust from which is conducted into a condenser where the exhaust steam is converted to water and supplied to the boiler to complete the cycle.

With steam turbines equipped with a bypass system, the steam admission valves to the turbine may be closed, or partially closed, while still allowing steam to be produced by the boiler at a load level independent of steam turbine load. The bypass system is advantageously used for hot restarts or to keep the boiler on-line during plant or system transients that would normally require a trip (shutdown). Accordingly, bypass systems are provided in order to enhance on-line availability, obtain quick restarts, and minimize turbine thermal cycle expenditures.

In the operation of the power plant, a situation may arise wherein the electrical tie of the power line with a grid load network is interrupted. In such situations, it is still desirable to operate the steam turbine system at a house load level so as to supply the electrical needs of auxiliary equipment such as pumps, pulverizers, fans, etc. Under such conditions, the turbine will continue running at synchronous speed although with a greatly reduced steam flow and with the remainder of the boiler-produced steam being provided to the bypass system.

Ordinarily, sufficient steam flow must be passed through the turbine in order to keep the turbine elements cool. With the reduced flow rate conditions, however, a windage effect takes place whereby instead of extracting work from the steam, the turbine blades are actually doing work on the steam which is being churned up, resulting in a temperature increase which, in turn, causes the turbine parts to heat up. A danger therefore exists under such conditions, of turbine overheating past its design rating, thereby resulting in reduced life and possible premature failure.

The present invention provides for a significant improvement under such conditions whereby the turbine temperature is maintained within design limits.

SUMMARY OF THE INVENTION

The improved system includes, in addition to a normal bypass path, a second bypass path for passing steam around the high pressure turbine. This second bypass path includes a steam jet compressor means having one input section connected to the high pressure turbine exhaust output and another input section connected to receive steam from the steam generator. The output section of the steam jet compressor is connected to the other steam bypass line at the input of the reheater. A valving means is provided for controlling the steam supply from the steam generator to the steam jet compressor and a control means responsive to an output condition at the high pressure turbine output controls the valving means for the steam jet compressor. The arrangement provides a sufficiently low pressure at the high pressure turbine output so as to maintain the temperature thereat within design limits for the particular turbine steam flow.

DESCRIPTION OF THE PREFERRED EMBODIMENT

Figure 1:
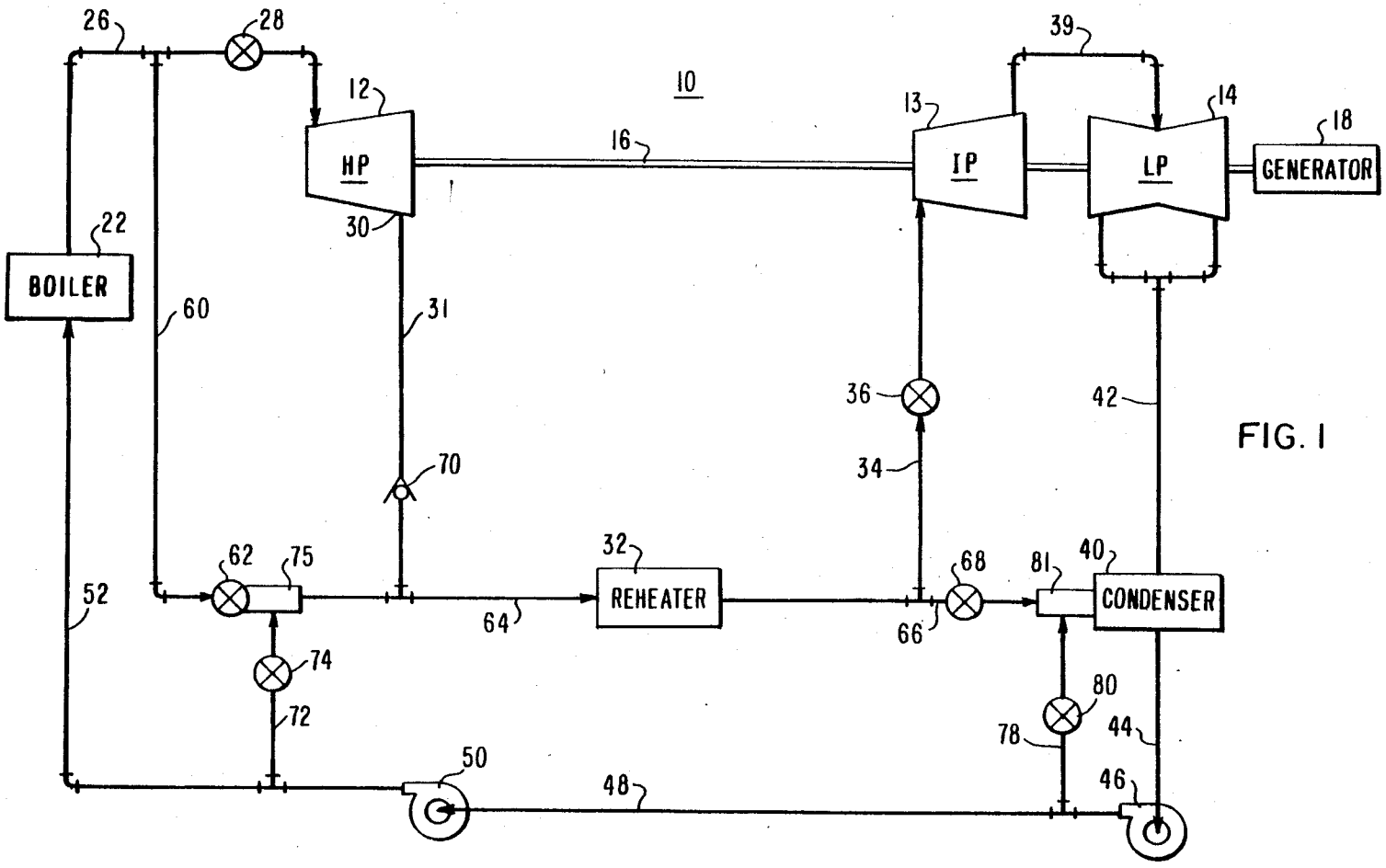
FIG. 1 is a simplified block diagram of a steam turbine generator power plant which includes a bypass system.

FIG. 1 illustrates a simplified block diagram of a fossile-fired single reheat turbine generator unit, by way of example. The turbine system 10 includes a plurality of turbines in the form of high pressure (HP) turbine 12, and at least one or more lower pressure turbines which, in the case of FIG. 1, include intermediate pressure turbine 13 and low pressure turbine 14. The turbines are connected to a common shaft 16 to drive an electrical generator 18 which supplies power to a load such as an electrical grid network (not illustrated).

A steam generating system, such as a conventional drum-type boiler 22 operated by fossile fuel, generates steam which is heated to proper operating temperatures and conducted through a throttle header 26 to the high pressure turbine 12, the flow of steam being governed by a set of steam admission valves 28.

Steam exiting the high pressure turbine 12 via the high pressure turbine exhaust output 30 and steam line 31 is conducted to a reheater 32 (which generally is in heat transfer relationship with boiler 22) and thereafter provided via steam line 34 to the intermediate pressure turbine 13 under control of valving arrangement 36. Thereafter, steam is conducted via steam line 39, to the low pressure turbine 14, the exhaust from which is provided to condenser 40 via steam line 42 and converted to water. The water is provided back to the boiler 22 via the path including water line 44, pump 46, water line 48, pump 50, and water line 52. Although not illustrated, water treatment equipment is generally provided in the return line so as to maintain a precise chemical balance and a high degree of purity of the water.

In order to enhance on-line availability, optimize hot restart, and prolong the life of the boiler, condenser, and turbine system, there is provided a turbine bypass arrangement whereby steam from boiling 22 may continually be produced as though it were being used by the turbines, but in actuality bypassing them. The bypass path includes steam line 60, with initiation of high pressure bypass operation being effected by actuation of high pressure bypass valve 62. Steam passed by this valve is conducted via steam line 64 to the input of reheater 32 and flow of the reheated steam in steam line 66 is governed by a low pressure bypass valve 68 which passes the steam to the condenser 40. In order to prevent the bypassed steam from entering the high pressure turbine in the reverse direction, that is through outlet 30 via steam line 31, there is provided a nonreturn or check valve 70 located in that steam line.

In order to compensate for the loss of heat extraction normally provided by the high pressure turbine 12 and to prevent overheating of the reheater 32, relatively cool water in water line 72, provided by pump 50, is provided to the bypass steam under control of spray valve 74 and desuperheating assembly 75. In a similar fashion, relatively cool water in water line 78, provided by pump 46, is controlled by valve 80 and provided to desuperheater assembly 81 in order to cool the steam in the low pressure bypass path to compensate for the loss of heat extraction normally provided by the intermediate and low pressure turbines 13 and 14, and to prevent overheating of condenser 40.

Although not illustrated, it is common to provide analog or digital control systems for operation of the illustrated valves as well as for efficient operation of the boiler.

The windage heating which can cause extensive damage to the high pressure turbine 12 is a function of turbine rotor speed as well as the density of the steam being passed through the high pressure turbine. When operating under house load conditions with a low steam flow, the turbine speed is maintained at its design synchronous speed. The density of the steam therefore is a variable which affects the windage heating and the density increases with increased pressure at outlet 30. The problem is particularly serious in a power plant having a 100 percent bypass system.

Valve 62 in the bypass path, throttles some of the boiler output pressure down to a certain value for presentation to the input of reheater 32. This pressure is known as the cold reheat pressure. Accordingly, if the exhaust pressure at outlet 30 is high and equivalent to the cold reheat pressure, then a flow of steam could be maintained from the turbine to the reheater. This elevated pressure however would result in windage heating which is totally unacceptable for the turbine design. The pressure at outlet 30 must be kept relatively low so as to maintain the operating temperature within design limits; however, such low pressure is not compatible with the pressure conditions at the input of reheater 32 and therefore cannot be directly connected thereto. The present invention provides a solution and to this end reference is made to FIG. 2 wherein components previously described in FIG. 1 have like reference numerals.

Figure 2:
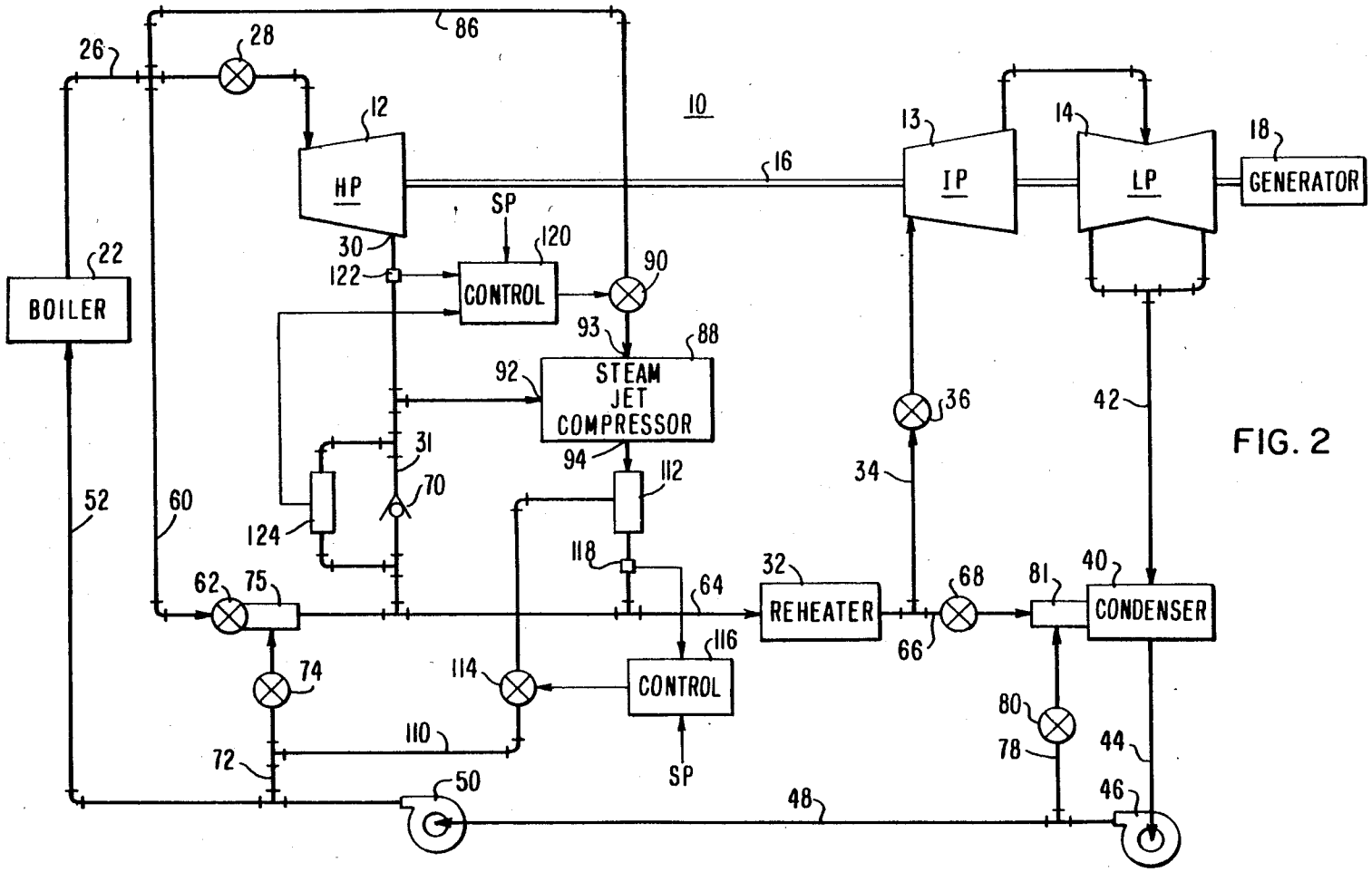
FIG. 2 illustrates the power plant of FIG. 1 together with an embodiment of the present invention.

In FIG. 2 a second bypass path around the high pressure turbine 12 is provided and includes a steam line 86 which provides boiler steam to a steam jet compressor 88 through a control valve 90. The steam jet compressor 88 includes one input 92 in steam communication with outlet 30 of high pressure turbine 12, a second input 93 in steam communication with the boiler, via control valve 90, and an output 94 which is in steam communication with bypass line 64 at the input of reheater 32.

Figure 3:
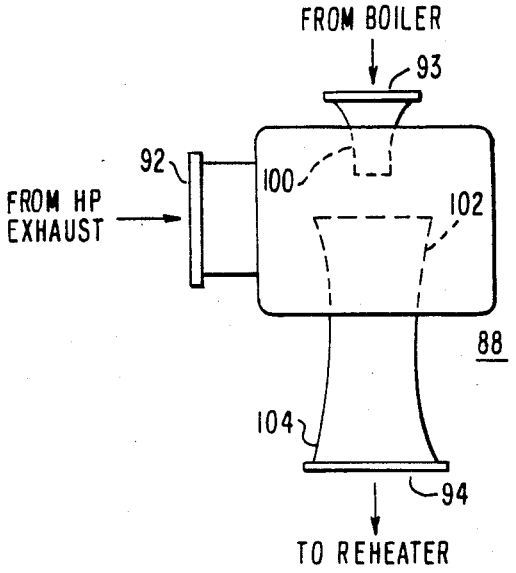
FIG. 3 is a simplified illustration of a steam jet compressor utilized in the present invention.

The steam jet compressor, also known as a steam jet pump or steam jet air ejector, is a well-known piece of apparatus used for many years in steam power plants for extracting air from condensers. With reference to FIG. 3, and as used in the present invention, the exhaust steam at outlet 30 is provided at a relatively low pressure to input 92 of the steam jet compressor 88. Relatively high pressure motive steam from the boiler enters at input 93 and issues as a high speed jet of steam from nozzle 100. The mixture of the high pressure and low pressure gases enters the converging tube 102 in which an exchange of momentum takes place and after which the mixture flows into a diffuser 104 in which the velocity of the mixture is reduced and its pressure raised to a value compatible with the cold reheat pressure. In essence, the steam jet compressor 88 acts as a compressor for raising the pressure of the exhaust steam at outlet 30 to a high enough value where it can be discharged into the reheater while still maintaining the proper pressure conditions on the reheater. The steam jet compressor is a relatively compact and simple piece of equipment which has no rotary, or any moving parts, is extremely reliable, and relatively inexpensive.

Referring once again to FIG. 2, since the output of the steam jet compressor is at a temperature which is too high for the reheater, a spray water arrangement is provided so as to cool the steam. Cooling water from pump 50 may be provided via water line 110 to the desuperheating assembly 112 connected in the output line of the steam jet compressor. Control of the cooling water is provided by valve 114, the opening of which is governed by a control circuit 116 which senses the temperature of the steam from desuperheat assembly 112 by means of a temperature sensor 118 and compares this value with a predetermined setpoint value SP to open valve 114 more should the temperature be greater than the setpoint value and to reduce the cooling water flow should it be less than the setpoint value.

Operation of the steam jet compressor 88 has the effect of maintaining a relatively low pressure at the output 30 of high pressure turbine 12 for a given steam flow rate condition and for increasing this pressure such that the turbine discharge may be provided to the other bypass line at the input of reheater 32. In this manner, the temperature of the high pressure turbine will be maintained within design limits. If for some reason the turbine temperature should rise, valve 90 may be controlled so as to pass more motive steam to the steam jet compressor 88 so as to pull the pressure at the output 30 down to a value whereby the temperature reduces. Conversely, if the temperature decreases, valve 90 may be controlled to supply less motive steam, resulting in an increase in pressure. Accordingly, in order to control valve 90, a control circuit 120 is provided and examines a condition at the output 30. This condition preferably is a temperature reading which is indicative of turbine temperature and which may be sensed by temperature sensor 122 for providing a temperature signal to the control circuit 120 and which signal is compared with a predetermined allowable range as represented by setpoint SP for governing operation of the valve 90.

When it is time to increase electrical load for reconnection to the electrical grid network, more steam flow is sent to the high pressure turbine 12 through steam admission valves 28 and the steam flow in the main bypass path of steam line 60 is proportionally reduced. Although outlet 30 will experience a pressure rise, the temperature will not necessarily rise since there is now greater steam flow through the turbine. If during the switchover from bypass to main steam the exhaust temperature of the high pressure turbine should deviate from allowable limits, control circuit 120 will further open or close valve 90 so that steam jet compressor 88 maintains the proper pressure condition at the outlet to maintain the desired temperature while pumping up the pressure of the exhaust for discharge into the reheater.

When steam flow conditions and exhaust pressure are such that high pressure exhaust steam flows through check valve 70, there is no more requirement for the operation of steam jet compressor 88. Accordingly, means are provided to sense this condition and, as an example, a pressure differential transducer 124 may be provided for sensing the pressure across check valve 70 to provide an indication of the opening thereof, such indication being provided to control circuit 120 for shutting down valve 90.

Figure 4:
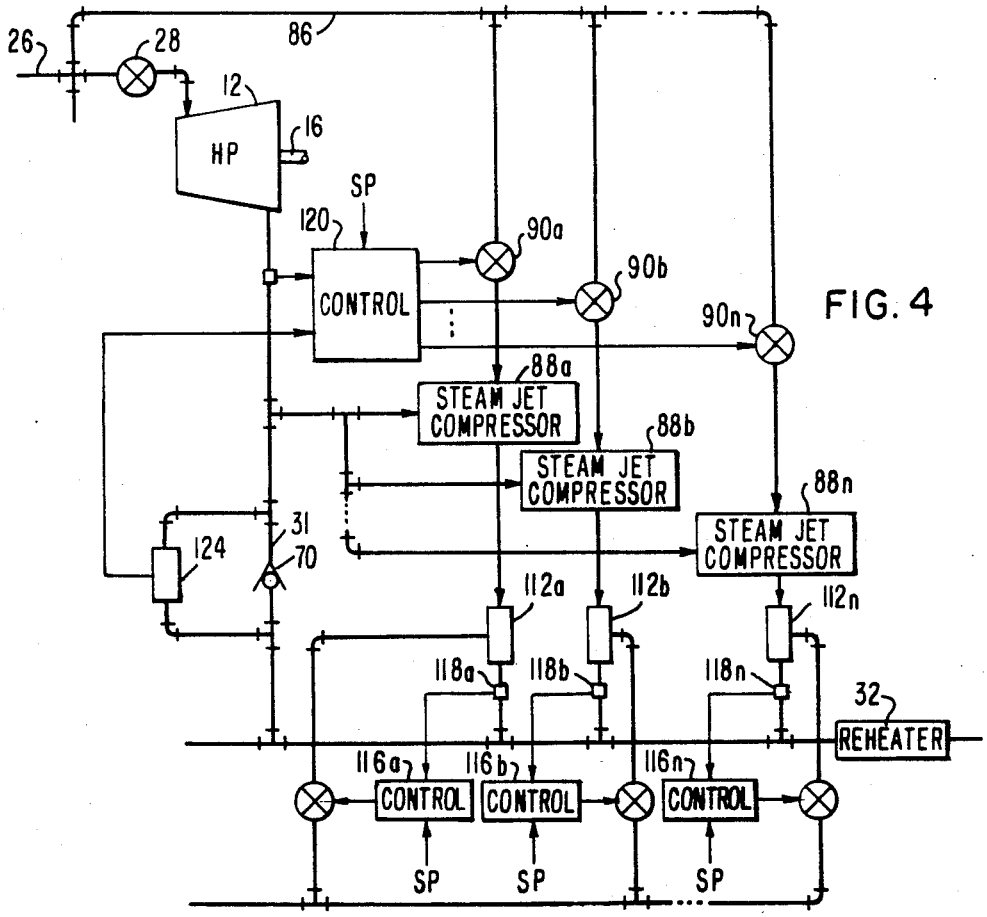
FIG. 4 illustrates a modification of the arrangement of FIG. 2.

Depending upon the steam system, flow and pressure requirements, it may be that the pressure ratios involved are too large for a single steam jet compressor. In such instance a plurality of such compressors may be utilized as illustrated in FIG. 4 which includes a plurality of steam jet compressors 88*a*, 88*b*, . . . 88*n*, all operating in parallel. Each steam jet compressor has an associated control valve 90*a*, 90*b*, . . . 90*n* as well as water spray control circuits 116*a*, 116*b*, . . . 116*n* for controlling spray water to desuperheater assemblies 112*a*, 112*b*, . . . 112*n* in response to a setpoint and the temperature measured in the respective lines by temperature sensors 118*a*, 118*b*, . . . 118*n*.

Control circuit 120 still senses the temperature at the high pressure outlet 30 to sequentially open the control valves as needed as the outlet temperature rises, or conversely to shut them down in sequence when the outlet temperature drops, until such point in the sequencing operation that the temperature attains its design range.

Accordingly, the power plant is able to achieve full load in a relatively short period of time since the boiler 22 may be maintained at full load independent of the turbine. While in a bypass condition, the high pressure turbine is prevented from overheating by the auxiliary bypass path which maintains the proper pressure, and therefore temperature, at the high pressure exhaust. The auxiliary bypass path accomplishes its function with the use of a device which has no moving parts, is relatively simple and inexpensive, and utilizes motive energy already available from the boiler.

What is claimed is:

1. In a steam turbine installation having a high pressure turbine, a steam generator for providing steam to said turbine, at least a lower pressure turbine, a reheater in the steam path between said high and lower pressure turbines, and a steam bypass path for bypassing said turbines, said high pressure turbine having a one-way check valve in its output steam line to prevent bypass steam from entering its output, the improvement comprising:

(A) a second bypass path for passing steam around said high pressure turbine;

(B) said second bypass path including, (i) steam jet compressor means including two input sections and an output section, with one said input section being connected to said high pressure turbine output, the other said input section being connected to receive steam from said steam generator and said output section being connected to the input of said reheater, (ii) valving means for controlling the steam supply from said steam generator to said steam jet compressor means; and (C) control means responsive to an output condition at said high pressure turbine output for controlling said valving means.

2. Apparatus according to claim 1 wherein:

(A) said steam jet compressor means is comprised of a single steam jet compressor.

3. Apparatus according to claim 1 which includes:

(A) temperature sensor means positioned to provide a temperature signal indicative of the temperature at the output of said high pressure turbine; and (B) said control means being responsive to said temperature signal for controlling said valving means.

4. Apparatus according to claim 1 which includes:

(A) means for cooling the steam output of said steam jet compressor prior to its delivery to said input of said reheater.

5. Apparatus according to claim 1 which includes:

(A) means for sensing the condition of said check valve and operable to close said valving means to shut off said second bypass path when said check valve is open.

6. Apparatus according to claim 5 wherein:

(A) said means for sensing is a differential pressure transducer connected across said check valve.

* * * * *